US007748296B2

(12) United States Patent
Hu

(10) Patent No.: US 7,748,296 B2
(45) Date of Patent: Jul. 6, 2010

(54) RATCHET SCREWDRIVER WITH AN ACCELERATING STRUCTURE

(75) Inventor: Cheng-Tsan Hu, Tainan Hsien (TW)

(73) Assignee: Gong Fong Enterprise Co., Ltd., Tainan Hsien (TW)

( * ) Notice: Subject to any disclaimer, the term of this patent is extended or adjusted under 35 U.S.C. 154(b) by 165 days.

(21) Appl. No.: 12/179,031

(22) Filed: Jul. 24, 2008

(65) Prior Publication Data

US 2010/0018366 A1 Jan. 28, 2010

(51) Int. Cl.
*B25B 17/00* (2006.01)
*B25B 13/46* (2006.01)

(52) U.S. Cl. ..... 81/57.3; 81/62

(58) Field of Classification Search ..... 81/57.3, 81/58.1, 60–62

See application file for complete search history.

(56) References Cited

U.S. PATENT DOCUMENTS

| | | | | |
|---|---|---|---|---|
| 3,945,274 | A * | 3/1976 | Annett, II | 81/58.1 |
| 4,846,027 | A * | 7/1989 | Lu | 81/57.3 |
| 6,457,385 | B1 * | 10/2002 | Hu | 81/57.3 |
| 7,055,410 | B2 * | 6/2006 | Hu | 81/62 |
| 7,185,565 | B1 * | 3/2007 | Hu | 81/62 |
| 2007/0256524 | A1 * | 11/2007 | Cornwell et al. | 81/57.3 |

* cited by examiner

*Primary Examiner*—D. S Meislin
(74) *Attorney, Agent, or Firm*—Rosenberg, Klein & Lee

(57) ABSTRACT

A ratchet screwdriver with an accelerating structure is provided, in particular to one combined a ratchet seat and a solar gear system. The ratchet seat controls the operating direction, and the solar gear system increases the output rpm for a user to choose high or low revolution to facilitate tightness or looseness of a screw.

6 Claims, 6 Drawing Sheets

RATCHET SCREWDRIVER WITH AN ACCELERATING STRUCTURE

BACKGROUND OF THE INVENTION

1. Field of the Invention

The present invention relates to a ratchet screwdriver with an accelerating structure, and more particularly to one equipped with a ratchet seat and a solar gear system to facilitate operation.

2. Description of the Prior Art

A conventional screwdriver is used to tighten or loosen fasteners, such as screws or nuts. However, the conventional screwdriver is unable to provide abilities of acceleration and orientation.

Taiwanese Patent Published No. 533956 disclosed a rotating structure for a precise screwdriver, which provides an accelerating function. But, it is unable to provide the accuracy and the convenience of operation.

The above-mentioned patent has some shortcomings, such as:

1. A solar gear structure can only increase the speed of tool, which is unable to change direction and locate its position.
2. A lack of locating device will cause an inverse operation and decrease the speed.

Another Taiwanese Patent Published No. M263195 disclosed a screwdriver having a locating structure. However, it lacks of lower torque, high revolution output, neither does it has the convenience of operation concept, other than the above shortcomings, it is able to control deviation without the locating means, thus the invention applies a high torque input to a lower torque requirement, which consumes a lot of energy.

Although all of the above-mentioned screwdrivers are able to meet the basic requirements, as to tighten or loosen a screw/nut, however, in consideration of functionality, economy and convenience, more over to the production line, there still exists much space to be filled.

SUMMARY OF THE INVENTION

The present invention is to promote the functionality, economy and convenience of prior art and to facilitate operation, meanwhile, the present invention increases the locating and accelerating abilities.

According to the present invention, there is provided a ratchet screwdriver with an accelerating structure, comprising:

a ratchet seat comprising a barrel, a ratchet, two blocks, two springs and a socket unit, said ratchet having a first through hole and two slots therein, said two slots interconnecting with said first through hole and disposed at two opposite sides of said ratchet;

a front handle connected to said ratchet seat, said front handle comprising a second chamber, a second through hole, and a third chamber, a circular inner gear meshing with a number of planet gears being provided in said third chamber, each said planet gear comprising a shaft connected with a pair of circular boards at upper and lower ends thereof;

a rear handle coupled to the front handle, said rear handle having a third through hole at one end and a fourth chamber at another end thereof, a number of holes being formed around said third through hole corresponding in position to said shaft of each said planet gear;

a sleeve connecting rod comprising a first end, a second end, and a pair of engaging blocks corresponding to and seating in said slots of said ratchet, said first end of said sleeve connecting rod being provided with a solar gear, said solar gear being disposed among said planet gears and meshing with said planet gears, said first end of said sleeve connecting rod being provided with a first connecting member behind said solar gear, said first connecting member passing through said third through hole of said rear handle and entering said fourth chamber of said rear handle, a second connecting member being connected with said first connecting member to secure said sleeve connecting rod to said rear handle; and a tail cap coupled to said rear handle, said tail cap comprising a number of compartments therein.

Preferably, said barrel has a first chamber therein, two levers being provided in said first chamber, said blocks and said springs being disposed in said first chamber, said ratchet having a number of ratchet teeth outwardly, said ratchet further comprising a pair of circular grooves and a pair of fasteners corresponding to said circular grooves at two ends thereof, said socket unit comprising a nut at one end and a sleeve at another end thereof, said nut being inserted into said barrel, said sleeve comprising protruding strips outwardly.

Preferably, said fasteners of said ratchet are shaped like an English letter C.

Preferably, said second chamber has recesses corresponding to said protruding strips of said socket unit for connecting said front handle with said ratchet seat.

Preferably, said second end of said sleeve connecting rod is formed with a compartment.

Preferably, said first connecting member is a screw and said second connecting member is a nut.

It is the primary object of the present invention to provide a ratchet screwdriver with an accelerating structure, which is simple in structure, cost-effective and easy to maintain.

It is another object of the present invention to provide a ratchet screwdriver with an accelerating structure, which provides a solar gear system and a ratchet seat to achieve the locating and accelerating mode. This design also saves the time of operation.

It is a further object of the present invention to provide a ratchet screwdriver with an accelerating structure, which uses a ratchet seat to keep the present invention in a correct direction when operating on a screw or a nut.

It is still a further object of the present invention to provide a ratchet screwdriver with an accelerating structure, which uses a solar gear system to accelerate its output as well as torque.

DETAILED DESCRIPTION OF THE PREFERRED EMBODIMENT

Figure 1:
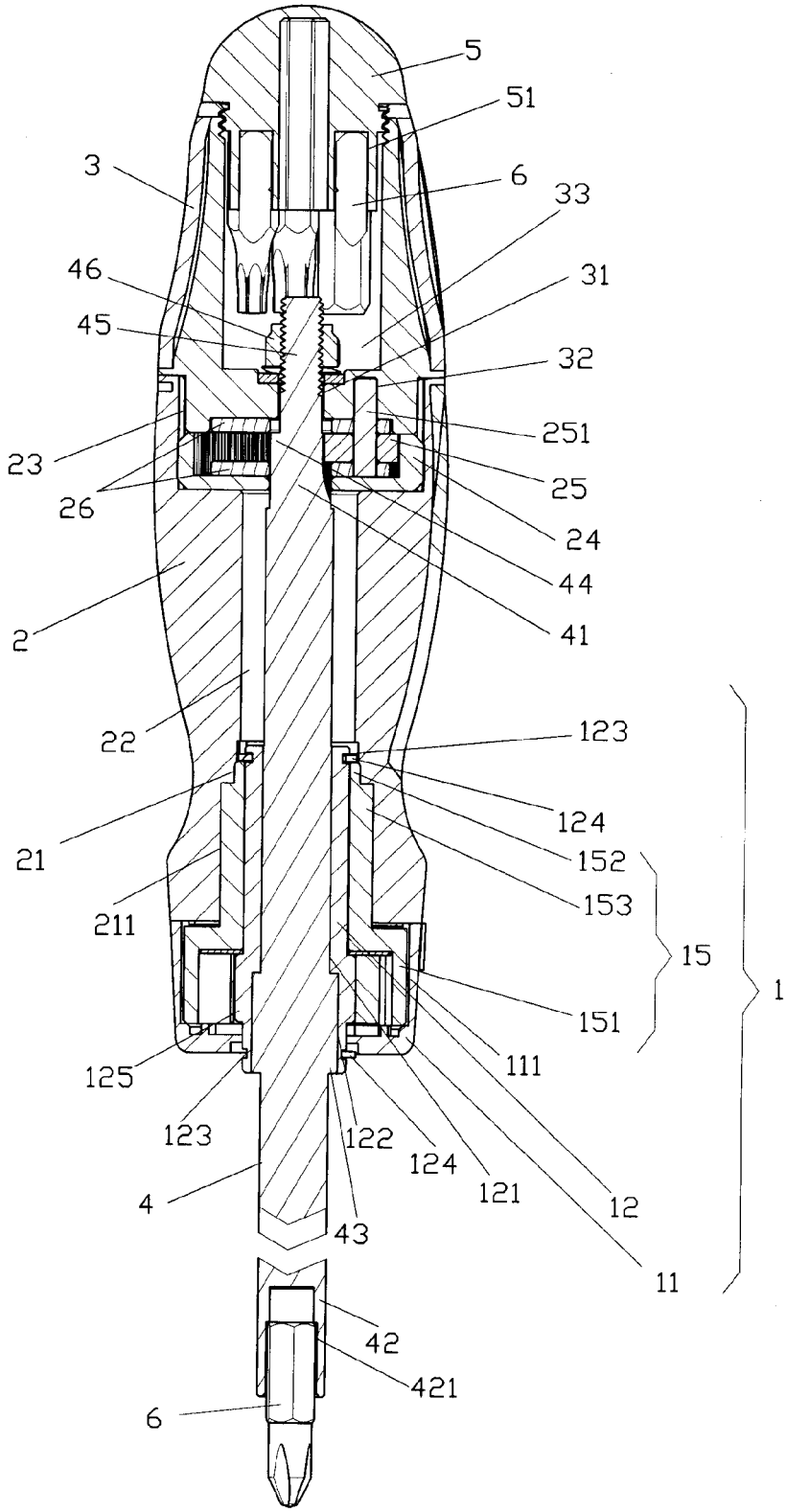
FIG. 1 is a cross-sectional view of the present invention.
Figure 2:
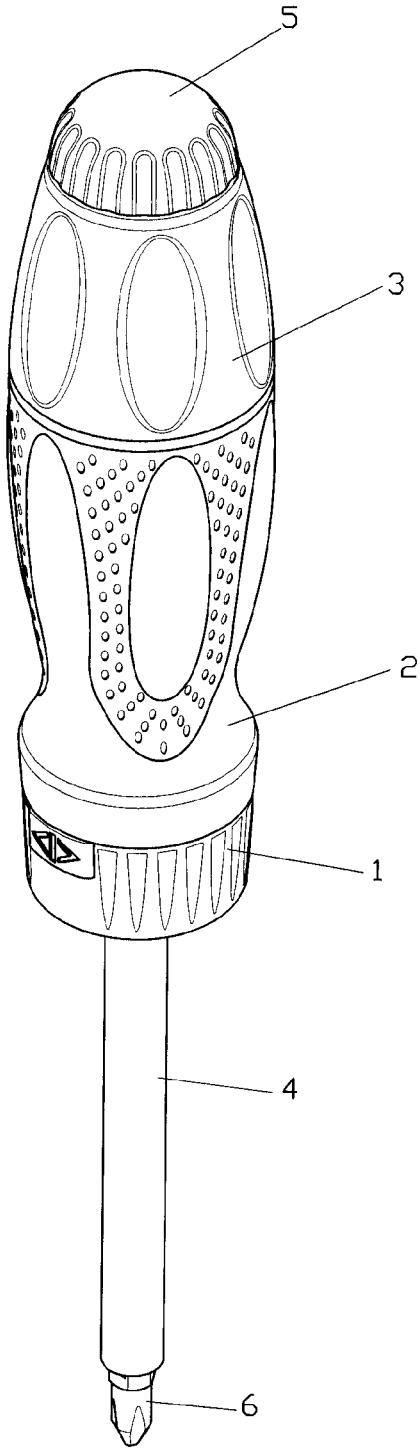
FIG. 2 is a perspective view of the present invention.
Figure 3:
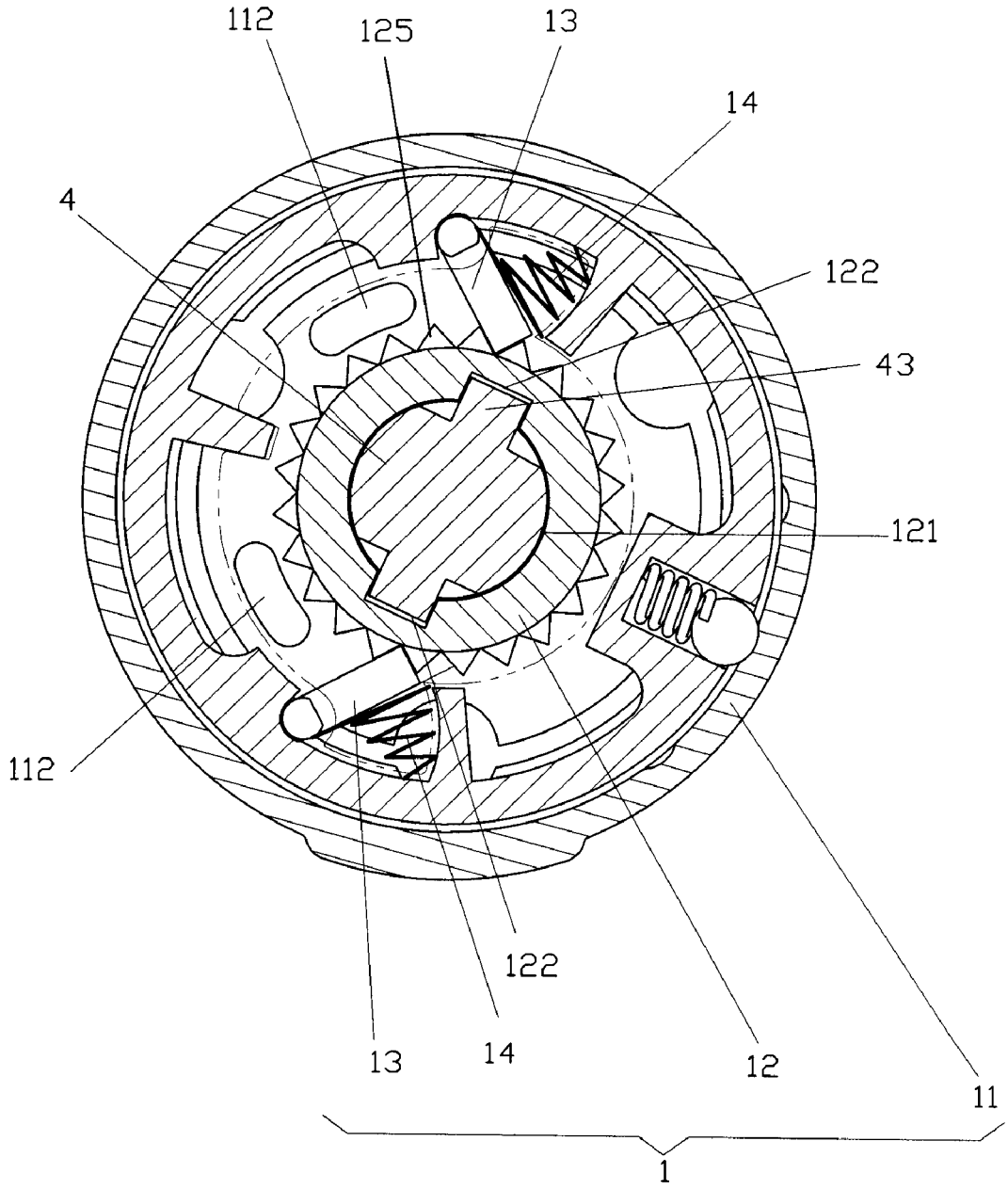
FIG. 3 is a cross-sectional view showing a ratchet restrained by two blocks.

As shown in FIGS. 1 through 3, the present invention comprises a ratchet seat 1, a front handle 2, a rear handle 3, a sleeve connecting rod 4, and a tail cap 5.

The ratchet seat 1 comprises a barrel 11, a ratchet 12, two blocks 13, two springs 14, and a socket unit 15. The barrel 11 has a first chamber 111 therein. Two levers 112, the blocks 13 and the springs 14 are disposed in the first chamber 111. The ratchet 12 comprises a number of ratchet teeth 125 outwardly, a first through hole 121 and two slots 122. The two slots 122 are interconnected with the first through hole 121 and disposed at two opposite sides of the ratchet 12. The ratchet 12 further comprises a pair of circular grooves 123 and a pair of fasteners 124 at two ends thereof. The socket unit 15 comprises a nut 151 at one end and a sleeve 52 at the other end thereof. The nut 151 is inserted into the barrel 11. The sleeve 152 comprises protruding strips 153 outwardly. The fasteners 124 of the ratchet 12 are shaped like an English letter C.

The front handle 2 comprises a second chamber 21, a second through hole 22 and a third chamber 23. The second chamber 21 has recesses 211 to accommodate the protruding strips 153 of the socket unit 15 so that the front handle 2 is connected with the ratchet seat 1. A circular inner gear 24 and a number of planet gears 25 meshing with the circular inner gear 24 are provided in the third chamber 23. Each of the planet gears 25 comprises a shaft 251 to connect with a pair of circular boards 26 at upper and lower ends thereof.

The rear handle 3 is coupled to the front handle 2 and comprises a third through hole 31 at one end and a fourth chamber 33 at another end thereof. A number of holes 32 are formed around the third through hole 31 corresponding in position to the shafts 251 of the planet gears 25.

The sleeve connecting rod 4 has a first end 41, a second end 42, and a pair of engaging blocks 43. The engaging blocks 43 are located in the two slots 122 of the ratchet 12, respectively. The first end 41 of the sleeve connecting rod 4 is provided with a solar gear 44. The solar gear 44 is disposed among the planet gears 25 and meshes with the planet gears 25. The sleeve connecting rod 4 is provided with a first connecting member 45 located behind the solar gear 44. The first connecting member 45 is inserted through the third through hole 31 of the rear handle 3 and into the fourth chamber 33. A second connecting member 46 is connected with the first connecting member 45 so that the sleeve connecting rod 4 is coupled to the rear handle 3. The second end 42 of the sleeve connecting rod 4 has a compartment 421. The first connecting member 45 is a screw, and the second connecting member 46 is a nut.

The tail cap 5 is coupled to the rear handle 3 and has a number of compartments 51 adapted to accommodate screwdriver heads 6 therein.

To assemble the present invention, as shown in FIG. 1, the engaging blocks 43 of the sleeve connecting rod 4 engage with the two slots 122 of the ratchet 12. The first connecting member 45 is inserted through the third through hole 31 and into the fourth chamber 33 of the rear handle 3. The second connecting member 46 is threaded to the first connecting member 45 so that the sleeve connecting rod 4 is connected to the rear handle 3. This completes the assembly of the present invention.

Figure 4:
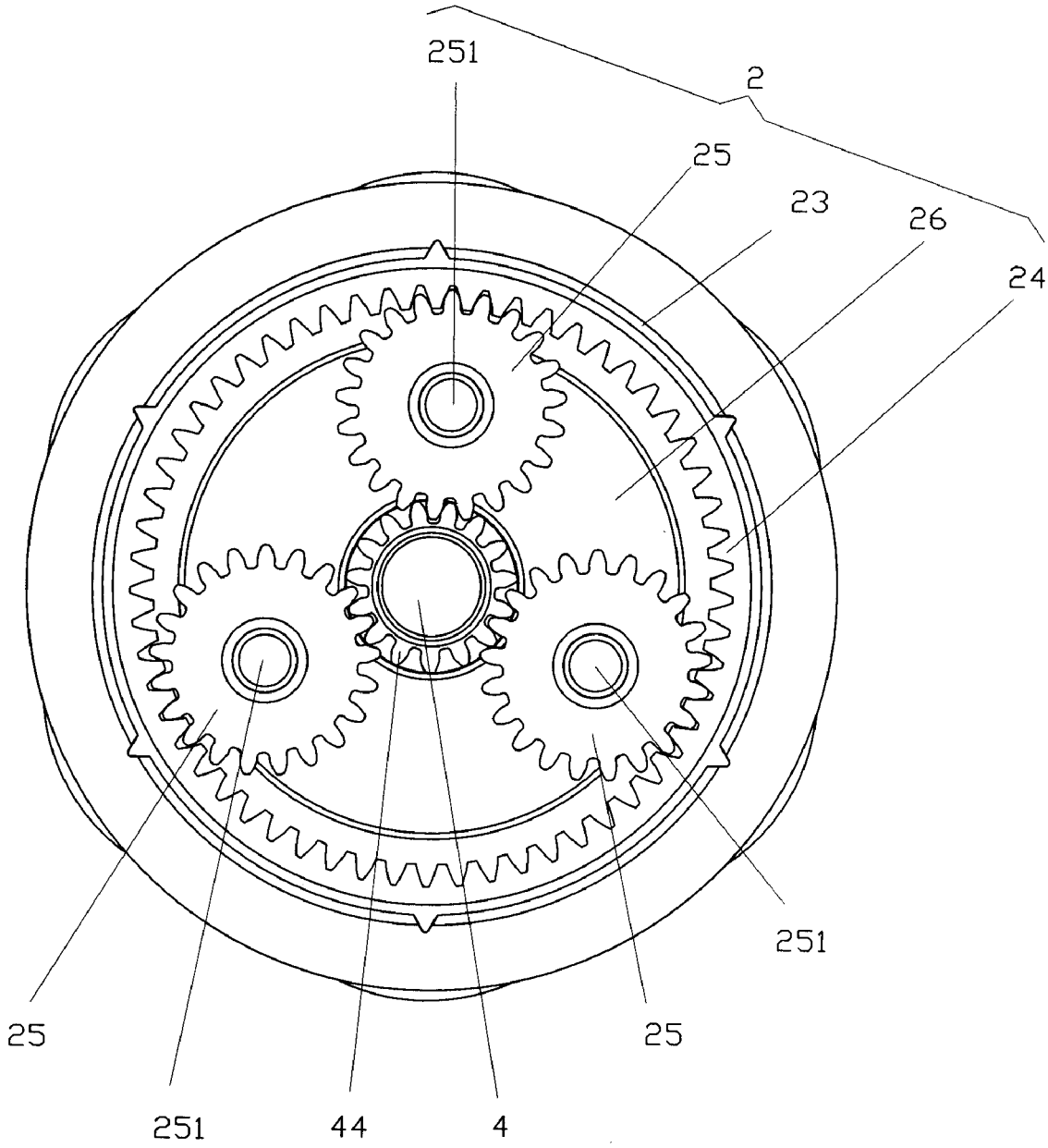
FIG. 4 is an illustrative view showing a solar gear system of the present invention.

FIGS. 3 through 6 show the locating operation of the ratchet seat 1 and accelerating rotation of the solar gear system. The solar gear system includes the circular inner gear 24 and the planet gears 25 of the front handle 2 and the solar gear 44 of the sleeve connecting rod 4, as shown in FIG. 4.

As shown in FIG. 3, when the barrel 11 is in the position of homing, the blocks 13 will engage with the ratchet teeth 125 of the ratchet 12 and the engaging blocks 43 of the sleeve connecting rod 4 will be locked in the two slots 122 of the ratchet 12, respectively. The sleeve connecting rod 4 is confined from movement with respect to the ratchet 12, which means that the sleeve connecting rod 4 and the screwdriver move at the same time. As shown in FIG. 4, the solar gear system remains steady, thus there is no accelerating function. The present invention is able to provide with more torque force to loosen or to tighten a screw.

Figure 5:
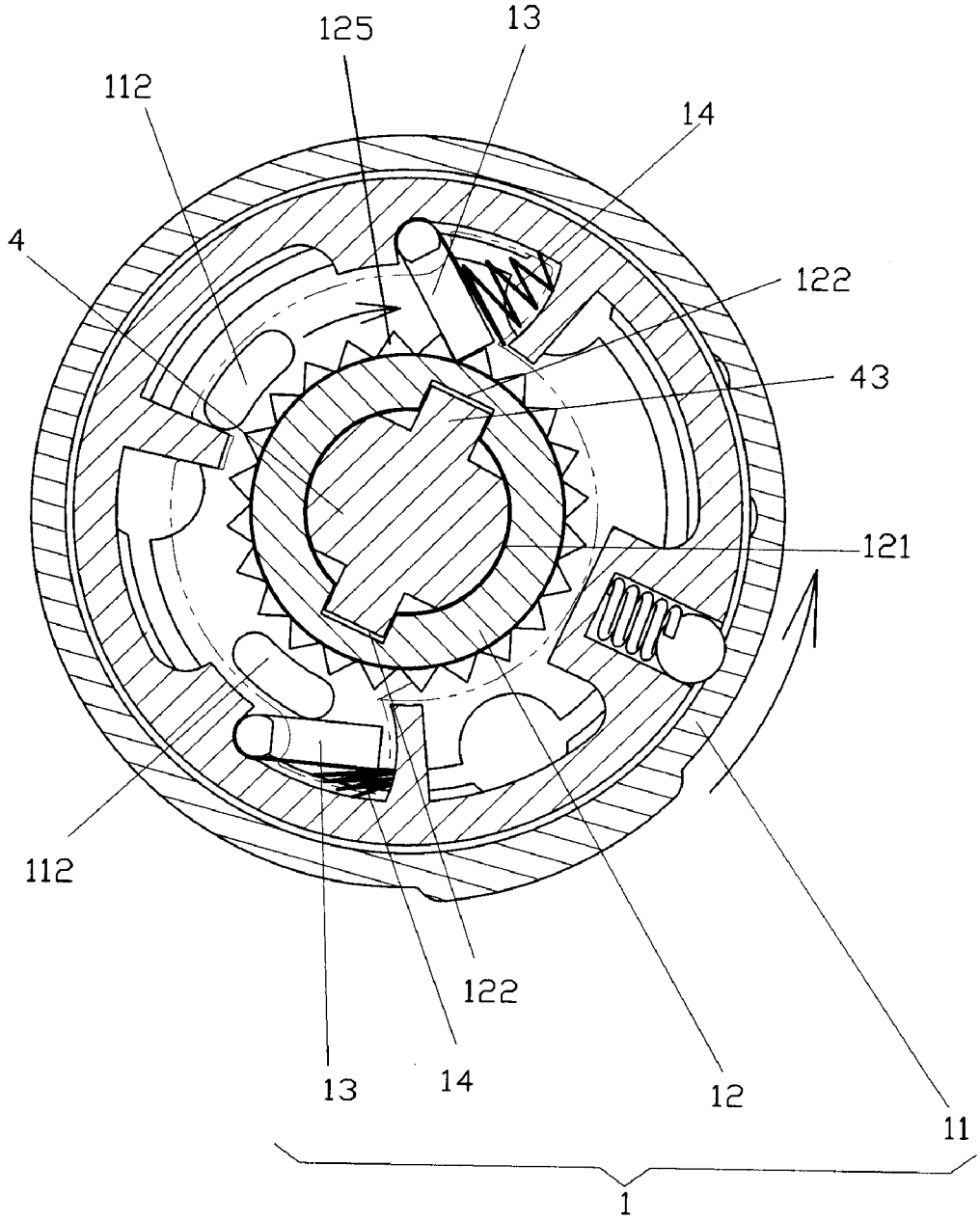
FIG. 5 is a view similar to FIG. 3 showing the ratchet engaged with one side of the barrel and a block at one side in a released status.
Figure 6:
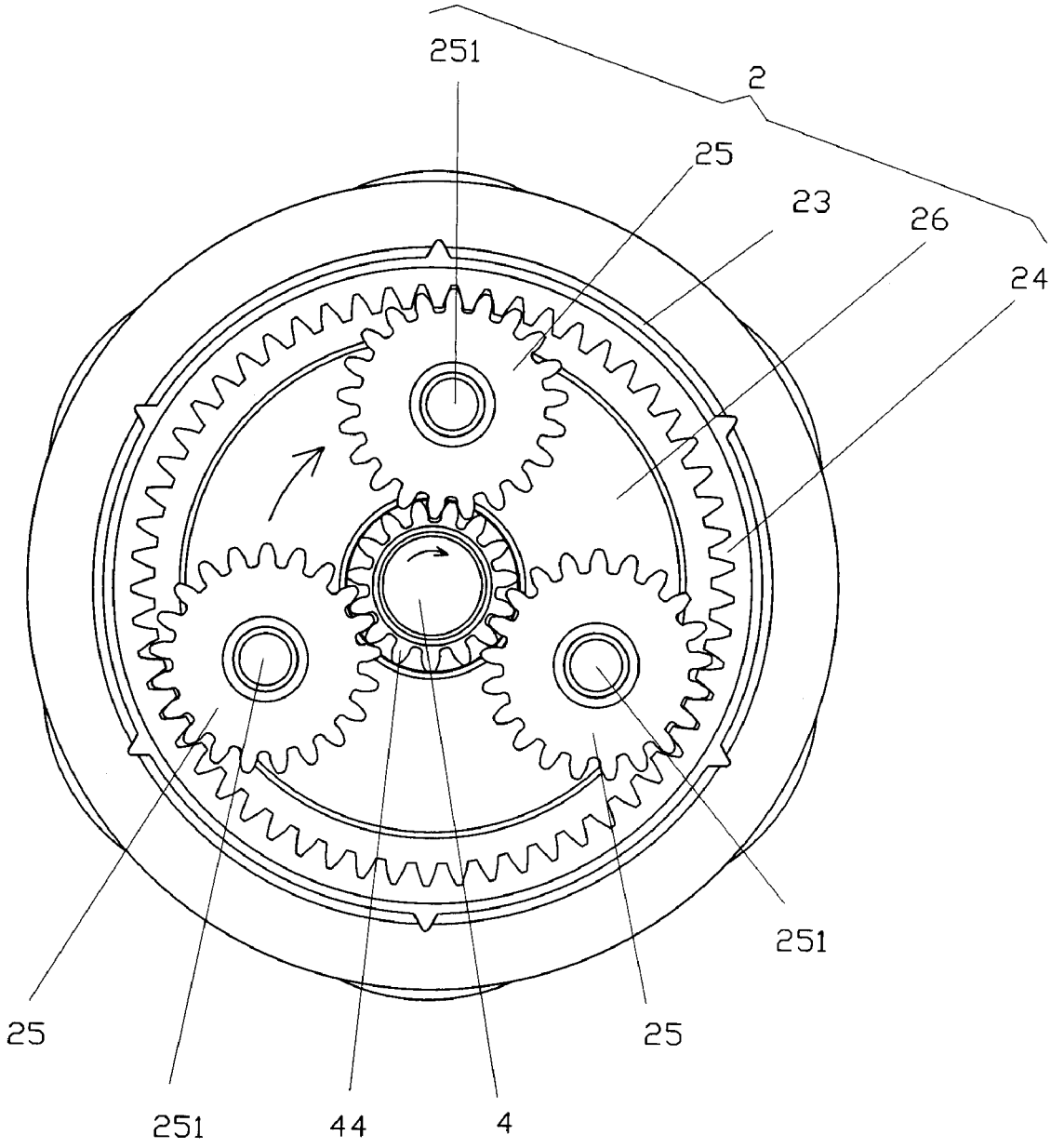
FIG. 6 is a view similar to FIG. 4 showing the solar gear system in an operating status.

As shown in FIGS. 5 and 6, when the barrel 11 is rotated counterclockwise/clockwise, one of the blocks 13 will mesh with the ratchet teeth 125 of the ratchet 12, as shown in FIG. 5, while the other block 13 will be blocked by the lever 112 of the barrel 11 to release from the ratchet teeth 125 of the ratchet 12, so that the present invention is in a one way locked status. The two engaging blocks 43 of the sleeve connecting rod 4 are located in the two slots 122 of the ratchet 12 so that the sleeve connecting rod 4 may be rotated clockwise with respect to the ratchet 12, which means upon the rear handle 3 is turned clockwise, causing the sleeve connecting rod 4 and the front handle 2 to rotate, as shown in FIG. 6. The rotation of the rear handle 3 links the shafts 251 of the planet gears 25 to rotate due to the planet gears 25 meshing with the circular inner gear 24 of the front handle 2. The planet gears 25 are rotated to link the solar gear 44 of the sleeve connecting rod 4 to rotate in clockwise direction, thus accelerating the rotation speed of the sleeve connecting rod 4. In other words, when the rear handle 3 rotates one cycle, the sleeve connecting rod 4 will rotate more than one cycle, thus the screwdriver of the present invention can tighten or loosen a screw quickly.

According to the above description, it is understood that the screwdriver of the present invention is able to control the orientation by the ratchet seat and to accelerate rotation by the solar gear system so as to facilitate tightness or looseness of a screw.

What is claimed is:

1. A ratchet screwdriver with an accelerating structure, comprising:

a ratchet seat comprising a barrel, a ratchet, two blocks, two springs and a socket unit, said ratchet having a first through hole and two slots therein, said two slots interconnecting with said first through hole and disposed at two opposite sides of said ratchet;

a front handle connected to said ratchet seat, said front handle comprising a second chamber, a second through hole, and a third chamber, a circular inner gear meshing with a number of planet gears being provided in said third chamber, each said planet gear comprising a shaft connected with a pair of circular boards at upper and lower ends thereof;

a rear handle coupled to the front handle, said rear handle having a third through hole at one end and a fourth chamber at another end thereof, a number of holes being formed around said third through hole corresponding in position to said shaft of each said planet gear;

a sleeve connecting rod comprising a first end, a second end, and a pair of engaging blocks corresponding to and seating in said slots of said ratchet, said first end of said sleeve connecting rod being provided with a solar gear, said solar gear being disposed among said planet gears and meshing with said planet gears, said first end of said sleeve connecting rod being provided with a first connecting member behind said solar gear, said first connecting member passing through said third through hole of said rear handle and entering said fourth chamber of said rear handle, a second connecting member being connected with said first connecting member to secure said sleeve connecting rod to said rear handle; and a tail cap coupled to said rear handle, said tail cap comprising a number of compartments therein.

2. The ratchet screwdriver with an accelerating structure, as recited in claim 1, wherein said barrel has a first chamber therein, two levers being provided in said first chamber, said blocks and said springs being disposed in said first chamber, said ratchet having a number of ratchet teeth outwardly, said ratchet further comprising a pair of circular grooves and a pair of fasteners corresponding to said circular grooves at two ends thereof, said socket unit comprising a nut at one end and a sleeve at another end thereof, said nut being inserted into said barrel, said sleeve comprising protruding strips outwardly.

3. The ratchet screwdriver with an accelerating structure, as recited in claim 2, wherein said fasteners of said ratchet are shaped like an English letter C.

4. The ratchet screwdriver with an accelerating structure, as recited in claim 1, wherein said second chamber has recesses corresponding to said protruding strips of said socket unit for connecting said front handle with said ratchet seat.

5. The ratchet screwdriver with an accelerating structure, as recited in claim 1, wherein said second end of said sleeve connecting rod is formed with a compartment.

6. The ratchet screwdriver with an accelerating structure, as recited in claim 1, wherein said first connecting member is a screw and said second connecting member is a nut.

* * * * *